US005593474A

United States Patent [19]

Keshavan et al.

[11] Patent Number: 5,593,474

[45] Date of Patent: Jan. 14, 1997

[54] COMPOSITE CEMENTED CARBIDE

[75] Inventors: Madapusi K. Keshavan, Irvine; Proserfina C. Rey, Laguna Beach, both of Calif.

[73] Assignee: Smith International, Inc., Houston, Tex.

[21] Appl. No.: 228,099

[22] Filed: Aug. 4, 1988

[51] Int. Cl.[6] ..... C22C 29/08

[52] U.S. Cl. ..... 75/240; 75/239; 75/241; 175/409; 175/410; 419/23; 419/14; 419/15; 419/17; 419/18

[58] Field of Search ..... 419/23, 14, 15, 419/17, 18; 75/255, 239, 240, 241, 242; 175/409, 410

[56] References Cited

U.S. PATENT DOCUMENTS

| | | | |
|---|---|---|---|
| 4,359,335 | 11/1982 | Garner | 75/208 R |
| 4,368,788 | 1/1983 | Drake | 175/374 |
| 4,505,746 | 3/1985 | Nakai et al. | 75/243 |
| 4,604,106 | 8/1986 | Hall et al. | 51/293 |
| 4,636,253 | 1/1987 | Nakai et al. | 75/239 |
| 4,705,124 | 11/1987 | Abrahamson et al. | 175/410 |
| 4,722,405 | 2/1988 | Langford, Jr. | 175/374 |
| 4,778,521 | 10/1988 | Iyori et al. | 75/237 |

*Primary Examiner*—Stephen J. Lechert, Jr.
*Assistant Examiner*—Leon Nigohosian, Jr.
*Attorney, Agent, or Firm*—Christie, Parker & Hale, LLP

[57] ABSTRACT

A composite material is disclosed along with the method of making the same. The material comprises a tough grade of cemented carbide granule dispersed with a hard brittle grade of cemented carbide granules to form a matrix. The quantity of hard, brittle cemented carbide granules is between 20% to 60% of the total composition. Such material functions to improve wear resistance without sacrificing toughness.

6 Claims, 2 Drawing Sheets

COMPOSITE CEMENTED CARBIDE

BACKGROUND OF THE INVENTION

1. Field of the Invention

The present invention relates generally to inserts utilized in rock bits and drilling tools and more particularly to the insert material composition and the method of manufacturing the same.

2. Description of the Prior Art

Cemented carbide is widely used as an insert material in TCI rock bits. As used in the following disclosure and claims, the term "cemented carbide" is intended to refer to the type of material resulting when grains of a carbide of the group IVB, VB or VIB metals are pressed and heated in the presence of a binder such as cobalt, nickel or iron as well as various alloys thereof, to produce solid integral pieces. The most common and readily available form of cemented carbide is tungsten carbide containing a cobalt binder. Different carbide grades are utilized in rock bits, the selection of which are dependent on the wear/erosion and mechanical properties thereof. These various properties are described in Assignee's, *Grade Properties Handbook*, published in 1987. A large portion of the handbook came from *World Directory and Handbook of Hardmetals,* 2nd Edition, Jetspeed Printing Service Limited, United Kingdom, 1979. These properties are also described in an article entitled Abrasion and Erosion of WC-CO Alloys, found in *Metal Powder Report*, Vol. 42, No. 12, December 1987. For the most part, the properties of the grade depends on the grain size of the carbide and the binder content. The wear/erosion resistance increases with decreasing carbide particle size and binder content. However, the toughness and impact resistance decreases with decreasing carbide particle size and binder content. As a result, compromises usually have to be made relating to such properties in the selection of materials for inserts.

As also used in the following disclosure and claims, the term "cermet" is intended to refer to a material consisting of ceramic particles bonded with a metal. A few years ago, it was widely accepted to make inserts from a homogeneous material having uniform grain size. Thereafter inserts-were manufactured consisting of a mixture of carbide grain sizes Which were cemented using a binder. The wear and erosion resistance of the carbide was changed by the use of bimodal grain size distribution, with an optimum size distribution existing for each binder content.

Manufacturing of the bimodal carbide grades involved mixing and milling the desired amounts of two grain sized carbide particles, preferably tungsten carbide particles, in an attritor or a ball mill with a binder such as cobalt. A liquid media was used in the mill with cemented carbide balls to facilitate good mixing and prevent any oxidation during milling. Wax was generally added in the mill which dissolves in the liquid media. The mills were water cooled. The milling time depended on a number of variables such as the tungsten carbide/cobalt amount, size and the desired mechanical properties. The milled powder was then dried and granulated and sized, which was required for good flowability during pressing. Finally, the granulated powder was pressed and sintered.

It has been found that the various properties mentioned above vary in a linear relationship as the distribution of the two grain sizes vary. For example, the hardness and toughness of a mixture containing a single grain size will steadily vary and change to the hardness and toughness of the other grain size as the amount of the second grain size increases in the mixture. Therefore, in varying the mixture from a pure amount of one grain size, to a pure amount of the second grain size, the hardness and toughness properties will vary in a linear relationship and in an inverse manner.

As a result, although slightly better wear and mechanical properties have been achieved with this process, compromises still had to be made.

Other types of composite carbide inserts have been utilized which have the flexibility of producing products with improved toughness for a given wear resistance and vice-versa.

A number of different approaches to producing these inserts has been taken, but basically, such inserts comprise a coating or layer of hard material bonded to a base member having good toughness qualities. Such contructions are shown in U.S. Pat. Nos. 4,359,335; 4,705,124; and 4,772,405. Some of these constructions have been successful but problems do exist with brazing or bonding such materials together. U. S. Pat. No. 4,604,106 teaches the use of a transition layer between the layers to aid in the bonding.

Another type of construction found in cutting tools utilizes gradient composite metallic structures across the geometry of the cutting structure, such as described in U.S. Pat. No. 4,368,788. However, such a process is limited in application, difficult to control, and quite complex.

SUMMARY OF THE INVENTION

The present invention provides a unique composite material and the method of manufacturing the same material functioning to improve wear resistance without sacrificing toughness. The method consists of interspersing a tough grade of cemented carbide or cermet with a hard, brittle grade of cemented carbide or cermet. This is accomplished by forming each grade by milling and granulating it individually and then mixing the two amounts of granules carefully with out breaking down the granules. As can be seen, this differs from the prior art methods which mix the raw material of different grain sizes together before the milling and granulation process.

It is preferable that no more than 60% and no less than 20% of the mixture contains the hard grade of carbide or cermet. It has been found that in this range, the hardness and crack resistance properties remain substantially constant while the wear resistance is doubled compared to other types of composite inserts.

These and other advantages will be more fully shown in the detailed description of the preferred embodiments.

Figure 3:
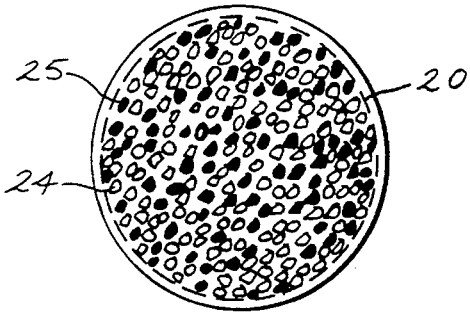
FIG. 3 is a side elevational view of a second embodiment of the present invention.

DESCRIPTION OF THE PREFERRED EMBODIMENTS AND BEST MODE FOR CARRYING OUT THE INVENTION

Tungsten carbide inserts are classified by grade according to the average grain size of the tungsten carbide and the percentage amount by volume of the cobalt binder. The average grain size usually varies from 0.5 to 10 microns while the cobalt content varies from 6% to 16%.

As mentioned previously, a large grain size and high cobalt content insert has high toughness and impact strength and relatively low hardness and wear resistance properties. The tougher grade of cemented carbide has an average grain size of 2.5 to 10 microns. Conversely, inserts having a relatively small grain size and less cobalt content has high hardness and low toughness. The hard brittle grade of cemented carbide has an average grain size of 0.5 to 2.0 microns. For example, a grade having an average grain size of 3 to 4 microns and a cobalt content of 16% has a hardness range of 85.4 to 86.2 Rockwell A while a grade having an average grain size of 1.5 to 2.5 microns and a cobalt content of 8% ranges from 90.1 to 90.9.

Each grade is usually manufactured from a raw material of carbide particles of the desired grain size. These particles are then milled in an attritor or ball mill with the desired amount of cobalt. A liquid media is used in the mill with cemented carbide balls to facilitate good mixing and prevent oxidation. Wax is usually added in the mill which dissolves in the liquid media. The wax functions as an initial binder during the pressing process and is melted out of the material during the sintering process. The milling time depends on a number of variables but occurs long enough to achieve a desired mean particle size. The milled powder is then dried, granulated and sized. Granulation and sizing are required for good flowability of the powder during pressing.

In accordance with the present invention, a composite carbide is formed by interpersing a soft, tough carbide grade, with a hard and brittle grade. As will be shown later, the mechanical properties such as toughness and wear resistance will depend on the mixture.

In the preferred embodiment, a fifty-fifty mixture of granules from two grades are carefully mixed in a mixer without breaking down the granules. The first grade, called Grade A, preferably has an average grain size of approximately 2.2 microns with a 10.5% by weight cobalt content. The second grade, called Grade B, preferably has an average grain size less than of 1 micron with a 10% cobalt content. As shown in the selection of grades, it is preferable that there be substantially the same amount of cobalt content in both grades. As stated above, the mixture contains equal amounts of granules of Grades A and B with each granule consisting of globules containing quantities of carbide, cobalt and wax.

To complete the process, the mixture is pressed in a die to the desired shape and then sintered in a vacuum sintering furnace to enable the cobalt to bind the carbide particles together. Afterwards, the inserts can be machined or tumbled in the conventional manner. The last three process steps are well-known in the art and no modification had to be made either to these processes or to the machinery.

Although the preferred embodiment discloses cemented carbide as the composite material, other materials such as various grades of cermet can also be utilized.

Figure 1:
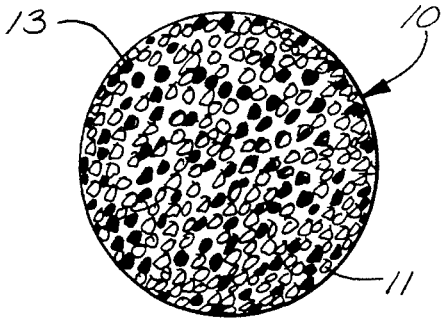
FIG. 1 is a side elevational view of the composite insert of the present invention embedded in the surface of a cone, a fragmentary portion of which is shown.
Figure 2:
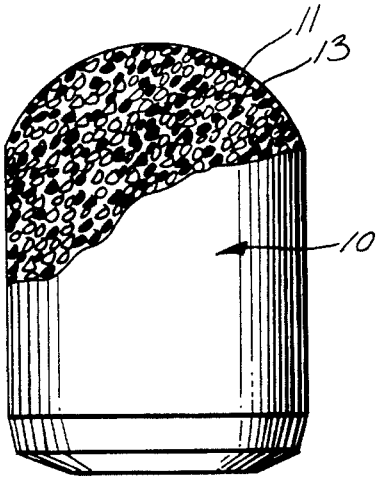
FIG. 2 is a top elevational view of the first embodiment of the present invention.

FIGS. 1 and 2 show a conventionally shaped insert 10 in which the entire structure is made from the composite carbide of the present invention. For illustrative purposes, a plurality of volumes of large grains 11 and volumes small grains 13 are shown, although they would not be distinguishable to the naked eye.

Figure 4:
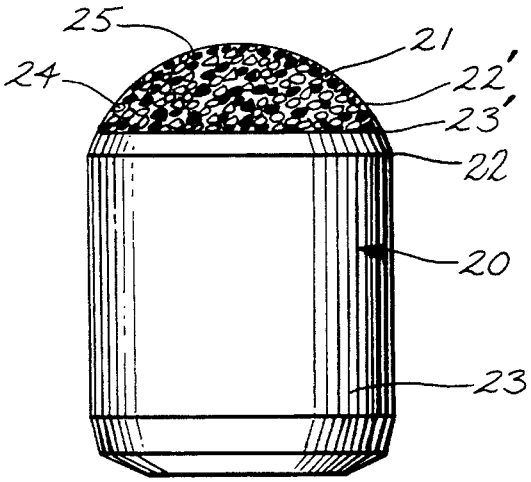
FIG. 4 is a top elevational view of the second embodiment of the present invention.

FIGS. 3 and 4 show a second insert 20 in which the cap 21 is made from the composite carbide of the present invention and the base 23 is formed from the Grade A carbide. Again, for illustrative purposes, the cap 21 includes a plurality of large volumes of grains 24 and volumes of small grains 25 bound together by the cobalt while the base 23 includes a plurality of large grains (not shown) bound together by the cobalt 28. In this embodiment, the cap 21 is metallurgically bonded to the base 23 in the conventional manner. It should be noted that the cylindrical base 23 also has a transition line 22 which changes to a hemispherical portion 22' which in turn is truncated by a flat surface 23'. The cap 21 also includes a mating flat surface 21' which is bonded thereto.

Figure 5:
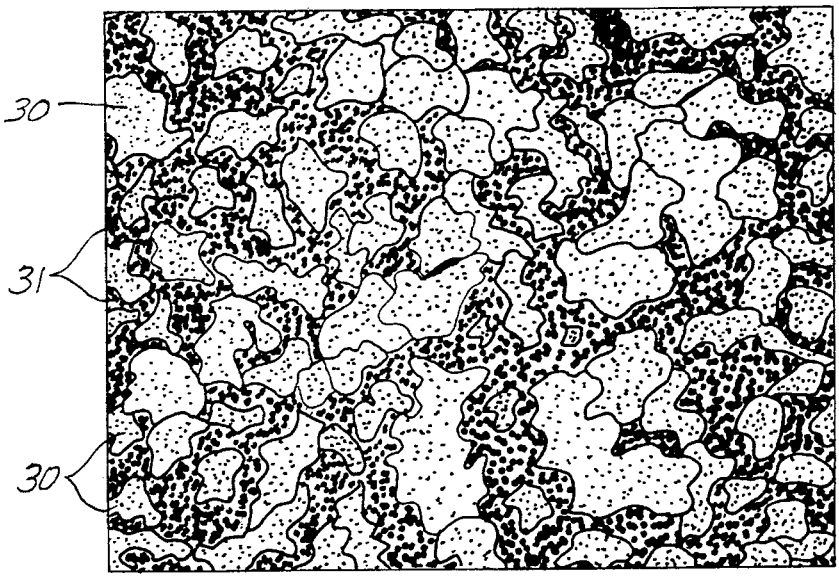
FIG. 5 is a drawn facsimile of a photomicrograph of a dispersion strengthened composite grade insert of the present invention.

FIG. 5 shows a photomicrograph 30 of the dispersion strengthened composite carbide of the present invention in which the structure has been magnified fifty times. Such a depiction shows a mixture of areas of large grains 31 and areas of small grains 33 evenly distributed throughout and bonded together by the cobalt.

A number of test samples (½ inch diameter and ¾ inch long) was made and measured for hardness and crack resistance (an indication of toughness). The three lots consisted of: 1) 100% of Grade B; 2) 100% of Grade A; and 3)50/50 dispersion of Grades B and A. Also, five inserts, as shown in FIG. 1, were made with the following compositions and also tested for hardness and crack resistance: 1) 100% of Grade B; 2) 25% of Grade B, 75% of Grade A; 3) 33% of Grade B, 67% of Grade A; 4) 50% of Grade B, 50% of Grade A; and 5) 100% of Grade A.

Figure 6:
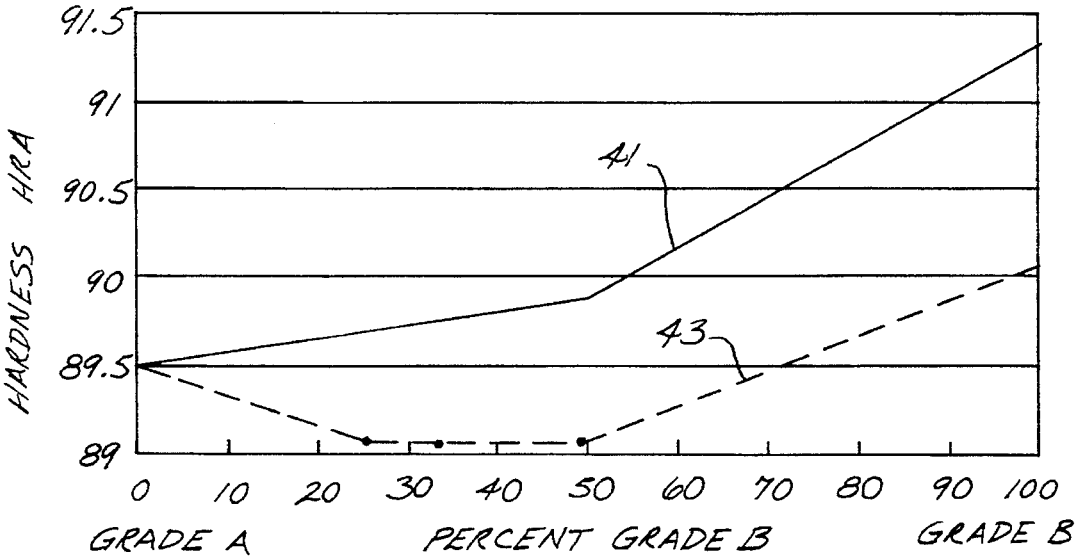
FIG. 6 is a graph plotting hardness to the percentage mixture of two grades of tungsten carbide.

FIG. 6 shows the results of the hardness test. The test sample results are shown by solid line 41 and the inserts shown by dotted line 43.

Figure 7:
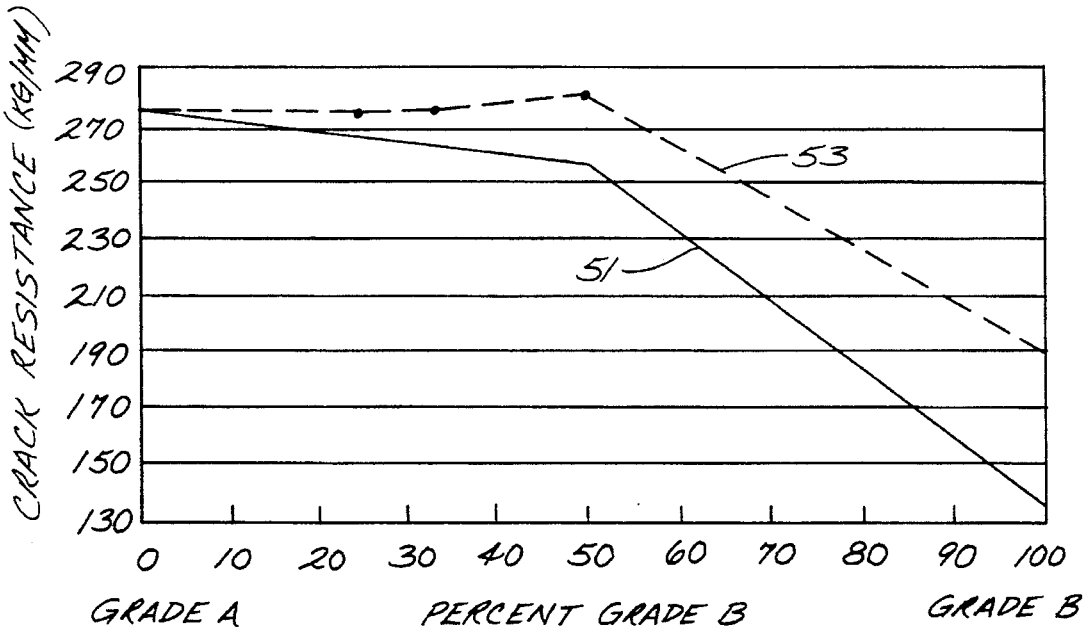
FIG. 7 is a graph plotting crack resistance i.e., toughness, to the percentage mixture of two grades of tungsten carbide.

FIG. 7 shows the results of the Palmquist crack resistance test with the test samples shown by solid line 51 and the inserts shown by dotted line 53.

As shown by these tests, the hardness of the test samples increased slightly with Grade B addition up to 50% by weight and the crack resistance decreases slightly. The change over this range is not appreciable. For the case of the inserts, the hardness decreases slightly with Grade B addition up to 50% by weight. Conversely, the crack resistance increases slightly. The difference in hardness and crack resistance in the test samples and the inserts is due to the difference in volume content of the dispersion zone.

It is important to note that between the ranges of 20% to 60% of Grade B there is little change in these measured properties. Only afterwards do these values approach the values of the 100% Grade B in a linear relationship. These relatively flat portions of the curves between 20% to 60% of Grade B were unexpected and were much different than the prior art materials which had a continuous linear slope between the two extremes i.e., the crack resistance constantly fell and the hardness constantly rose. The main advantage of this is that because of the flat portions of the curves between 20% and 60%, the designer has a wider choice of proportions to work with to get somewhat the same results. Whereas in the prior structures, a compromise had to be made between hardness and toughness.

Another advantage of the present invention is that in comparing the insert made according to the invention with a Grade A insert, the wear resistance of the former is twice that of the latter. In this same comparison, the load bearing capacity, fatigue resistance, and impact resistance of the composite carbide was better than a standard Grade A.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A sintered body of cemented metal carbide comprising:

a plurality of regions of a first type of cemented metal carbide; and a plurality of regions of a second type of cemented metal carbide, the first type of cemented metal carbide having a larger average particle size than the second type of cemented metal carbide and the second plurality of regions being interspersed with the first plurality of regions, the regions collectively forming the body of cemented metal carbide with the two types of regions being approximately uniformly distributed throughout the body.

2. The invention of claim 1 wherein said first and second types of metal carbide are tungsten carbide.

3. A body of cemented tungsten carbide as recited in claim 2 wherein the first type of cemented tungsten carbide has a greater toughness than the second type of cemented tungsten carbide.

4. A body of cemented tungsten carbide as recited in claim 2 wherein the body forms a cap on another portion of cemented tungsten carbide.

5. A body of cemented tungsten carbide as recited in claim 2 wherein said first type of cemented tungsten carbide has an average grain size of 2.5 to 10 microns.

6. A body of cemented tungsten carbide as recited in claim 2 wherein said second type of cemented tungsten carbide has an average grain size of 0.5 to 2.0 microns.

* * * * *